US008613788B2

(12) United States Patent
Hortig et al.

(10) Patent No.: US 8,613,788 B2
(45) Date of Patent: Dec. 24, 2013

(54) INCREASING THE STRENGTH OF IRIDIUM, RHODIUM, AND ALLOYS THEREOF

(75) Inventors: Uwe Hortig, Erlensee (DE); Verena Baier, Kuenzell (DE); Harald Manhardt, Bruchkoebel (DE); Oliver Warkentin, Pfungstadt (DE); David Francis Lupton, Gelnhausen (DE)

(73) Assignee: Heraeus Materials Technology GmbH & Co. KG, Hanau (DE)

( * ) Notice: Subject to any disclaimer, the term of this patent is extended or adjusted under 35 U.S.C. 154(b) by 218 days.

(21) Appl. No.: 12/824,398

(22) Filed: Jun. 28, 2010

(65) Prior Publication Data

US 2010/0329922 A1 Dec. 30, 2010

(30) Foreign Application Priority Data

Jun. 29, 2009 (DE) ..... 10 2009 031 168

(51) Int. Cl.
*C22B 11/00* (2006.01)
*C22C 5/04* (2006.01)

(52) U.S. Cl.
USPC ..... 75/392; 420/461

(58) Field of Classification Search
USPC ..... 420/461, 462; 75/392
See application file for complete search history.

(56) References Cited

U.S. PATENT DOCUMENTS

| | | | | |
|---|---|---|---|---|
| 3,918,965 | A | 11/1975 | Inouye et al. | |
| 3,970,450 | A | 7/1976 | Liu et al. | |
| 4,014,692 | A | 3/1977 | Costin | |
| 4,123,263 | A | 10/1978 | Costin | |
| 4,444,728 | A | 4/1984 | Lanam et al. | |
| 7,666,352 | B2 | 2/2010 | Ishida et al. | |
| 2008/0131306 | A1 * | 6/2008 | Jeong et al. | 420/423 |
| 2008/0206090 | A1 | 8/2008 | Ishida et al. | |
| 2008/0213123 | A1 | 9/2008 | Koch et al. | |

FOREIGN PATENT DOCUMENTS

| | | | |
|---|---|---|---|
| DE | 1577 09 | A1 | 12/1982 |
| DE | 10 2005 032 591 | A1 | 4/2007 |
| JP | 52-085919 | A | 7/1977 |
| JP | 56-081646 | A | 7/1981 |
| JP | 07-258767 | A | 10/1995 |
| JP | 10-259435 | A | 9/1998 |
| JP | 2001-303152 | A | 10/2001 |
| JP | 2006-032934 | A | 2/2006 |
| JP | 2008-019487 | A | 1/2008 |
| WO | 2004/007782 | A1 | 1/2004 |
| WO | 2007091576 | A1 | 8/2007 |

OTHER PUBLICATIONS

EP Search report issued Oct. 22, 2010 in EP Appin. No. 10005962.5.
E.K. Ohriner, "Purification of iridium by electron beam melting," Journal of Alloys and Compounds, vol. 461, pp. 633-640 (2007).
Y.F. Gu et al., "Microstructures and fracture behaviors of B-free and B-doped Ir3Nb (L12) intermetallic compounds," Materials Science and Engineering, A329-331, pp. 262-267 (2002).
German translation of an Office Action issued Oct. 19, 2012 in JP Application No. 2010-147186.

* cited by examiner

*Primary Examiner* — Rebecca Lee
(74) *Attorney, Agent, or Firm* — Panitch Schwarze Belisario & Nadel LLP

(57) ABSTRACT

The addition of 0.5 to 30 ppm boron and 0.5 to 20 ppm calcium to iridium and the Zr- and Hf-free alloys thereof and rhodium and the Zr- and Hf-free alloys thereof surprisingly increases the creep rupture strength at high temperatures, in particular around 1,800° C.

1 Claim, No Drawings

INCREASING THE STRENGTH OF IRIDIUM, RHODIUM, AND ALLOYS THEREOF

BACKGROUND OF THE INVENTION

The invention relates to iridium and the Zr- and Hf-free alloys thereof, as well as to rhodium and the Zr- and Hf-free alloys thereof, having high creep rupture strength at high temperatures.

Iridium, one of the metals of the platinum group, is used for example in crucibles for growing single crystals of high-melting oxidic melts, e.g. of Nd:YAG laser crystals, or in components for the glass industry. For these applications, not only the corrosion resistance with respect to oxidic melts, but also high creep resistance and creep rupture strength of the iridium at high temperatures are of crucial importance.

A method for increasing the creep resistance and creep rupture strength of iridium alloys is described in German published patent application DE 10 2005 032 591 A1. It involves doping with molybdenum, hafnium, and possibly rhenium, whereby the sum of molybdenum and hafnium is between 0.002 and 1.2 percent by weight. This allowed the time to rupture exposed to a load of 16.9 MPa to be increased more than two-fold as compared to undoped iridium.

International patent application Publication No. WO 2004/007782 A1 describes tungsten- and/or zirconium-containing iridium alloys for high temperature applications, which contain 0.01 to 0.5 percent by weight of further elements, such as molybdenum and hafnium and possibly 0.01 to 10 percent by weight ruthenium.

Japanese patent application publication no. JP 56-81646 A describes platinum-based jewellery alloys that contain calcium boride or boron to increase their strength, mainly their hardness, after a high temperature treatment, such as soldering.

BRIEF SUMMARY OF THE INVENTION

The presence of the tetravalent elements Zr and Hf in the iridium crucibles during the growth of some high-purity laser crystals is not desired, since they might lead to impurities in the crystal melt that have an adverse effect on the laser properties during later use. For this reason, it is an objective of the present invention to increase the creep rupture strength of iridium at high temperature while maintaining the ductility and processability of the material without using the elements mentioned above. Accordingly, it is advantageous for the respective material also to be free of titanium.

Surprisingly, it has been found that the addition of calcium and boron in the range of a few parts per million (ppm) increases the creep rupture strength at a temperature of 1,800° C. of iridium, doped as described, by 20 to 30% as compared to undoped iridium. It can be presumed that the same is also attained for iridium alloys as well as rhodium and the alloys thereof.

DETAILED DESCRIPTION OF THE INVENTION

The following examples illustrate the invention in more detail. As in the remainder of the description, specification of parts and percentages are by weight, unless stated otherwise.

COMPARATIVE EXAMPLE 8 kg of iridium were melted in a $ZrO_2$ crucible and poured into a water-cooled casting die. The iridium bar was subsequently forged at 1,600 to 1,700° C. and rolled in multiple steps to a final thickness of 1 mm. Before and between individual reduction stages, the bar or sheet was heated to 1,400° C. The hardness of the sheet was HV10=270. The samples for the stress rupture tests were taken from the rolled sheet.

A stress rupture curve was recorded for the iridium batch prepared as described using stress rupture tests at 1,800° C. In the test, the times to rupture were determined for applied structural loads between 6.7 and 25 MPa, and the values were subsequently approximated by a curve. The measured results are summarized in Table 1.

TABLE 1

Results of the creep rupture tests on pure iridium (no doping with calcium and boron)

| Load [MPa] | Time to rupture [hr] | Elongation at rupture [%] | Elongation rate [$sec^{-1}$] |
|---|---|---|---|
| 6.7 | 1403.7 | 18.2 | $3.2 \cdot 10^{-8}$ |
| 8.3 | 385.9 | 22.3 | $1.2 \cdot 10^{-7}$ |
| 9.5 | 225.0 | 23.9 | $2.6 \cdot 10^{-7}$ |
| 10 | 95.0 | 36.9 | $6.4 \cdot 10^{-7}$ |
| 13 | 56.8 | 50.0 | $9.4 \cdot 10^{-7}$ |
| 16 | 17.48 | 22.4 | $1.6 \cdot 10^{-6}$ |
| 18 | 10.1 | >50 | $1.4 \cdot 10^{-5}$ |
| 21 | 4.38 | 98.8 | $2.7 \cdot 10^{-5}$ |
| 23 | 1.67 | 13.5 | $1.5 \cdot 10^{-5}$ |
| 25 | 0.73 | 59.8 | $2.0 \cdot 10^{-4}$ |

The time to rupture varies in a range from 1,403.7 hr (approx. 58.5 days) at 6.7 MPa to 0.73 hr at 25 MPa and decreases with increasing load. While the elongation rate increases with increasing load, the elongation at rupture decrease shows no significant trend.

The following interpolated values for the creep rupture strength result from the creep rupture strength curve for predetermined times to rupture:

TABLE 2

Values from the creep rupture strength curve of the undoped Ir batch

| Time to rupture [hr] | Creep rupture strength [MPa] | Elongation rate [$sec^{-1}$] |
|---|---|---|
| 10 | 16.9 | $6.5 \cdot 10^{-6}$ |
| 100 | 11.0 | $5.6 \cdot 10^{-7}$ |
| 1000 | 7.2 | $4.9 \cdot 10^{-8}$ |

1st Inventive Embodiment 8 kg of iridium were melted in a $ZrO_2$ crucible and poured into a water-cooled casting die. Just before pouring, a pocket made of Pt foil (20 mm×20 mm×0.05 mm) filled with approx. 0.08 g (10 ppm) calcium and 0.08 g (10 ppm) boron was added into the melt.

The iridium bar was then forged analogously to the undoped iridium batch in the

Comparative Example and rolled to a final thickness of 1 mm. The hardness of the sheets was between HV10=226 and 242. Samples for the creep rupture strength tests and analyses were obtained from the rolled sheet.

A total of seven iridium batches was produced and tested by this means. GDL (glow discharge lamp) analyses were used to first determine the calcium and boron contents. The analytical results are shown in Table 3. The calcium and boron contents are close to identical for all batches. Note: Although calcium and boron were present in Batches A and B, the GDL analyses were not obtained.

TABLE 3

Results of the GDL analyses: Ca- and B-contents of the doped Ir batches

| Batch | Ca content [ppm] | B content [ppm] |
|---|---|---|
| A | — | — |
| B | — | — |
| C | 4 | 3 |
| D | 4 | 3 |
| E | 4 | 3 |
| F | 4 | 3 |
| G | 5 | 3 |

Based on the creep rupture strength curve of the undoped Ir batch, creep rupture tests were carried out at a temperature of 1,800° C. with a structural load of 16.9 MPa. Compared to the time to rupture of the undoped Ir batch of 10 hr (Table 2), clearly higher times to rupture from 17.93 hr to up to 56.52 hr (Table 4) were attained for the doped batches.

Aside from the increase of the time to rupture, it was observed that the elongation at break also tended to be increased as compared to undoped iridium. The minimum value of the elongation at break measured was 23%, while a maximum value of 73% was attained. The elongation rates of the doped iridium batches were between $1.0\times10^{-7}$ and $3.4\times10^{-6}$ $sec^{-1}$.

TABLE 4

Results of the creep rupture tests at 1,800° C. at a structural load of 16.9 MPa

| Batch | Time to rupture [hr] | Elongation at break [%] | Elongation rate [$sec^{-1}$] |
|---|---|---|---|
| A | 32.85 | 55 | $2.7\cdot10^{-6}$ |
| | 45.39 | 51 | $1.5\cdot10^{-6}$ |
| | 33.47 | 44 | $1.2\cdot10^{-6}$ |
| B | 22.48 | 51 | $2.2\cdot10^{-6}$ |
| | 17.93 | 68 | $2.2\cdot10^{-6}$ |
| | 19.30 | 64 | $3.4\cdot10^{-6}$ |
| C | 50.65 | 65 | $1.3\cdot10^{-6}$ |
| | 38.66 | 48 | $1.2\cdot10^{-6}$ |
| | 56.52 | 73 | $1.0\cdot10^{-6}$ |
| D | 29.94 | 73 | $2.0\cdot10^{-6}$ |
| | 18.88 | 56 | $2.2\cdot10^{-6}$ |
| | 42.67 | 29 | $9.8\cdot10^{-7}$ |
| E | 54.89 | 46 | $8.3\cdot10^{-7}$ |
| | 29.03 | 23 | $1.0\cdot10^{-7}$ |
| | 34.89 | 35 | $1.2\cdot10^{-6}$ |
| F | 53.79 | 56 | $9.0\cdot10^{-7}$ |
| | 35.66 | 39 | $1.1\cdot10^{-6}$ |
| | 29.32 | 45 | $1.5\cdot10^{-6}$ |
| G | 19.31 | 57 | $2.1\cdot10^{-6}$ |
| | 47.02 | 35 | $7.1\cdot10^{-7}$ |
| | 43.83 | 38 | $1.2\cdot10^{-6}$ |

2nd Inventive Embodiment

A creep strength curve was recorded at a temperature of 1,800° C. for batch F from the 1st Inventive Embodiment, in addition to the creep rupture strength test at 16.9 MPa. The structural loads applied were in the range of 14 MPa to 25 MPa. The results are shown in Table 5.

TABLE 5

Results of creep rupture strength tests at various structural loads

| Load [MPa] | Time to rupture [hr] | Elongation at break [%] | Elongation rate [$sec^{-1}$] |
|---|---|---|---|
| 14.0 | 95.53 | 28 | $2.6\cdot10^{-7}$ |
| 16.9 | 39.59 | 47 | $1.2\cdot10^{-6}$ |
| 18.5 | 21.71 | 75 | $1.5\cdot10^{-6}$ |
| 20.0 | 14.43 | 69 | $2.4\cdot10^{-6}$ |
| 23.0 | 8.81 | 69 | $9.0\cdot10^{-6}$ |
| 25.0 | 3.44 | 76 | $1.7\cdot10^{-5}$ |

After determination of the creep strength curve, the following interpolated creep rupture strength values were obtained for predetermined times to rupture:

TABLE 6

Values from the creep rupture strength curve of the calcium- and boron-doped Ir batch

| Time to rupture [hr] | Creep rupture strength [MPa] | Elongation rate [$sec^{-1}$] |
|---|---|---|
| 10 | 21.3 | $5.0\cdot10^{-6}$ |
| 100 | 14.3 | $3.1\cdot10^{-7}$ |
| 1000 | 9.5 | $1.8\cdot10^{-8}$ |

A comparison of these strength values to those of pure iridium at the same times to rupture shows that an increase of the creep rupture strength of at least 23% is attained at all times to rupture. The elongation rates of the interpolated values are clearly lower than those of pure iridium, especially at the lower structural loads. With regard to the elongations at break measured, almost three-fold higher values than for pure iridium are attained in some cases.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for increasing creep rupture strength of iridium metal, the method comprising adding 0.5 to 30 ppm boron and 0.5 to 20 ppm calcium by weight to pure iridium metal to produce doped iridium, wherein the doped iridium consists of iridium, calcium, and boron, and wherein the creep rupture strength of the doped iridium is 20 to 30% higher than that of the pure iridium metal.

* * * * *